United States Patent [19]

Panicci

[11] 3,990,455

[45] Nov. 9, 1976

[54] TEETHER

[75] Inventor: Richard L. Panicci, Hanover, Mass.

[73] Assignee: Kiddie Products, Inc., Avon, Mass.

[22] Filed: Apr. 21, 1975

[21] Appl. No.: 570,006

[52] U.S. Cl. ..... 128/359

[51] Int. Cl.[2] ..... A61J 17/00

[58] Field of Search ..... 53/28; 128/359, 360; 206/303

[56] References Cited

UNITED STATES PATENTS

| | | | |
|---|---|---|---|
| 2,421,574 | 6/1947 | Newmark | 128/359 |
| 2,703,087 | 3/1955 | Newmark | 128/359 |
| 3,026,658 | 3/1962 | Schneider et al. | 53/28 |
| 3,283,758 | 11/1966 | Killebrew | 128/359 |
| 3,529,397 | 9/1970 | Leasure | 53/28 |
| 3,690,324 | 9/1972 | Spivack | 128/359 |

*Primary Examiner*—Channing L. Pace

[57] ABSTRACT

A teether comprises an elongated, seamless tube of organic thermoplastic material. The tube is crimped at spaced intervals therealong and opposite sides of the tube are sealed together thereat. The seals are arranged to extend across the tube, each seal lying along a plane extending in one direction longitudinally along the tube and intersecting, at an angle, the plane of each adjacent seal. Preferably, the seals extend at right angles to the tube axis and adjacent seals lie along planes normal to each other.

10 Claims, 7 Drawing Figures

TEETHER

This invention relates to infant teethers and more particularly to plastic teethers having separate connected cells usually liquid filled and usually in the form of a ring.

Such teethers in the past have been made from sheet polyvinyl chloride, cut to form enlarged cells and narrow necks interconnecting adjacent cells. Two cut sheets are placed together, optionally with decorative objects therebetween, and sealed along their edges. Fluid is then injected into the tube, formed thereby, under pressure to inflate the cells. The ends of the tube are then sealed together to form a ring. Such a teether is not self-supporting in that, if leakage should occur, the cells will collapse as pressure decreases. The possibility of leakage occurring is enhanced by the long sealed seams along the cut sheet edges and by the interior fluid pressurization. Further, the sealed edges may occasionally present objectionable rough edges.

It is a principal object of the present invention to provide a teether having a generally smooth, self-supporting structure, which is not dependent upon internal pressure to essentially maintain its configuration. It is a further object of this invention, in preferred embodiments, to minimize the potential for leakage of liquids or gels contained therewithin. In another aspect of this invention it is an object to provide a simple, economical method for making a teether meeting the foregoing objections.

In one aspect the invention features a teether comprising an elongated tube of seamless organic thermoplastic material. A plurality of seals are positioned along the tube crimping it and joining opposite sides thereof at spaced intervals. Each such seal extends generally across the tube and lies along a plane extending in one direction generally longitudinally along the tube and intersecting, at an angle, the plane along which lies each adjacent seal.

In preferred embodiments, the invention additionally features: complete end seals lying in the same plane and joined to form a ring; partial seals intermediate the end seals; a nontoxic liquid or gel within the tube; decorative objects in the tube between seals; the planes of adjacent seals normal to each other; the seals extending in straight lines at right angles to the tube axis; and the seals curvilinear in section along the planes.

In another aspect the invention features the method of making the teether. A tube of organic thermoplastic material is crimped at spaced intervals therealong and seals are formed thereat sealing opposite sides of the tube together. Adjacent seals are formed across the tube, each seal along a plane at an angle to the plane of each adjacent seal.

In preferred embodiments of the method the seals are formed sequentially in the tube starting from one end; at least after the first seal is made the tube is arranged vertically and decorative objects are placed in the tube after formation of predetermined seals; the seals are formed only partially across the tube; after formation of the seals a nontoxic liquid or gel is inserted in the tube and the end seals are formed completely across the tube ends; and the seals are directed and the tube arranged in a loop as above indicated.

Other objects, features and advantages of this invention will be apparent to those skilled in the art from the following detailed description of a preferred embodiment thereof taken together with the accompanying drawings, in which.

Figure 1:
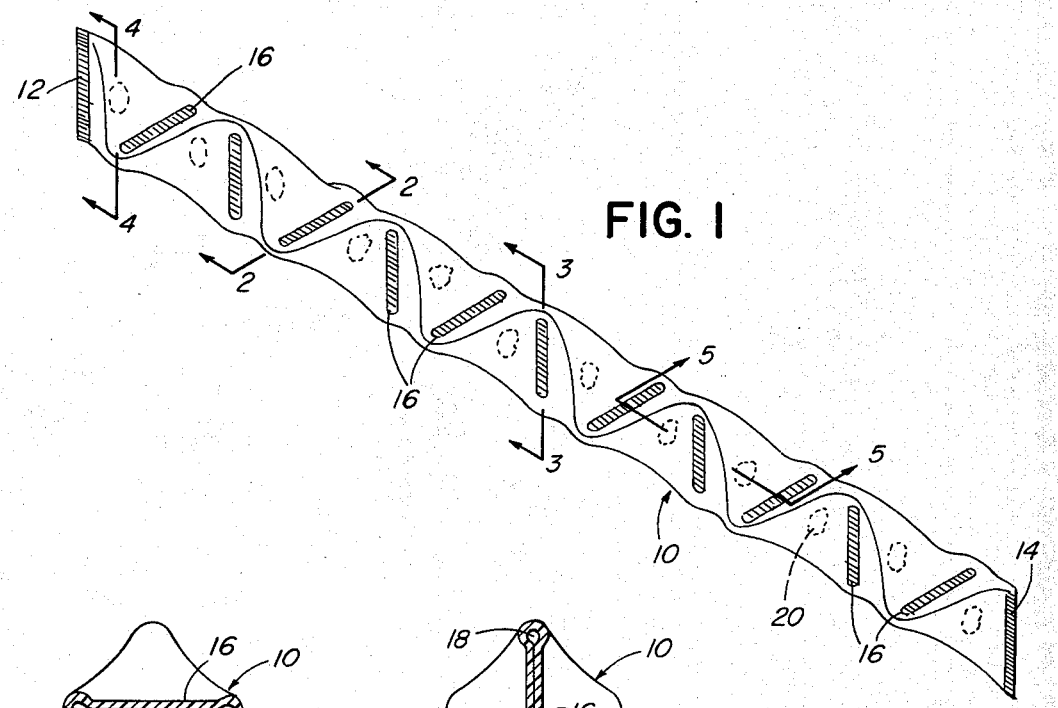
FIG. 1 is an isometric view of a teether according to the invention.
Figure 2:
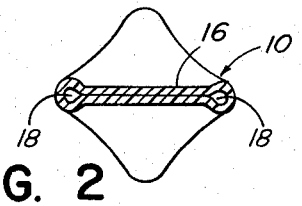
FIGS. 2–5 are, respectively, enlarged sectional views taken along the lines 2—2, 3—3, 4—4 and 5—5 of FIG. 1.
Figure 3:
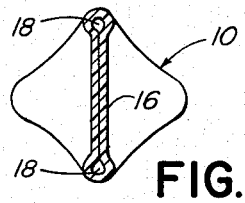

With reference to the drawings and particularly FIG. 1, the teether comprises an elongated tube 10 of seamless organic thermoplastic material, medical grade polyvinyl chloride in the preferred embodiment. A plurality of seals 12, 14 and 16 are positioned at spaced intervals along the tube 10. As illustrated in FIGS. 1, 2 and 3, the seals 12, 14 and 16 extend generally across the tube 10 joining opposite sides thereof together at spaced intervals. Each of the seals 12, 14 and 16 lies along a plane extending in one direction generally longitudinally along the tube and intersecting the plane of each adjacent seal at an angle.

In the illustrated embodiment the tube is filled with a nontoxic liquid 18, e.g., water, or gel at atmospheric pressure. End seals 12, 14 accordingly extend completely across tube 10. Intermediate seals 16, on the other hand, as shown in FIGS. 2 and 3, extend only across the center portion of tube 10 allowing communication at each end of the seals 16 between adjacent interior portions of the tube 10.

In the illustrated embodiment also seals 12, 14 and 16 extend in straight lines across the tube 10 at right angles to the tube axis. Adjacent ones of seals 12, 14 and 16 lie in planes normal to each adjacent seal. In the alternate preferred embodiment illustrated in FIG. 7, the seal 16' has a curvilinear cross-section along a plane.

Figure 5:
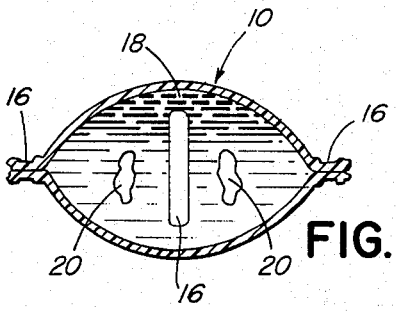
Figure 6:
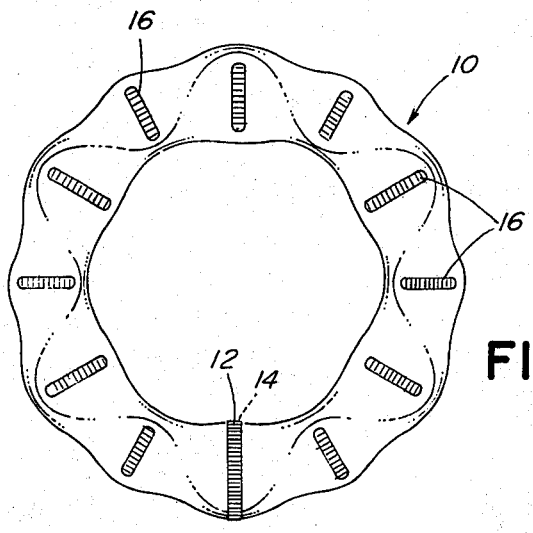
FIG. 6 is a plan view of a teether such as shown in FIG. 1 formed in a ring, its preferred configuration.

In a preferred form, end seals 12 and 14 lie in the same plane and the tube 10 is formed in a loop, as in FIG. 5. The end seals 12 and 14 are overlapped and sealed together to retain the loop configuration.

Figure 4:
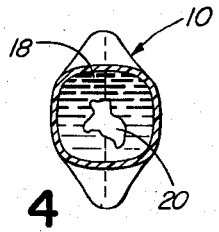

Transverse and longitudinal sections of the tube are illustrated in FIGS. 4 and 5. As also shown therein, decorative objects 20, e.g., animal figures or the like, may be placed in the tube sections between seals.

The transverse seals in intersecting planes provide a self-supporting tube configuration without the necessity of internal pressurization. The seamless tube construction, the short end seals, and the lack of internal pressurization minimize the potential for fluid leakage.

The method of making a teether, as above described, is as follows. A tube 10 of predetermined length is arranged with its axis in a vertical position. Tube 10 is crimped at its lower end and one end seal, e.g. seal 14, is first made in one plane partially across the lower tube end leaving a small opening into the tube. The tube is then crimped and intermediate seals are sequentially made from bottom to top in their respective planes, as above indicated, partially across the tube. As each seal is made, a decorative object is dropped into the tube before the next seal is made. The other end seal 12 is then made partially across the upper tube end. Thereafter the tube may be removed from its vertical position. Liquid is injected through the opening in one end seal and vacuum may be applied at the opening in the other end seal to fill the tube with a liquid or gel. When filled the end seals are then completed, the tube formed in a ring with end seals overlapping, and the end seals sealed together.

Figure 7:
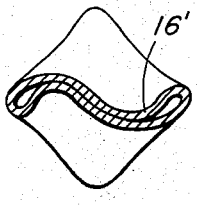
FIG. 7 is a view similar to that of FIG. 2 illustrating an alternate embodiment of seal configuation.

The various seals are formed by radio frequency (dielectric) sealing as is known in the art. To form a seal 16' as shown in FIG. 7 sealing electrodes are employed which have a configuration conforming to the desired seal cross-section. Polyvinyl chloride is a preferred material since its dielectric properties are well suited to such sealing techniques.

Other embodiments of this invention will occur to those skilled in the art which are within the scope of the following claims. By way of example double walled tubes with an inner tube of polyvinyl chloride and an outer tube of different material might be employed; similarly, a pair of parallel tubes, either separate tubes joined together or a single tube longitudinally centrally sealed, might be employed.

What is claimed is:

1. A teether, comprising:

an elongated, seamless tube of organic, thermoplastic material;

a plurality of seals positioned at spaced intervals along said tube, said seals crimping said tube and joining opposite sides of said tube together at said spaced intervals;

said seals comprising an end seal at each end of said tube extending completely across, closing and sealing said tube ends and further comprising a plurality of intermediate seals sealing opposite sides of said tube together and extending only partially across said tube communicating adjacent interior portions of said tube with each other around said intermediate seals; and said seals extending generally across said tube and lying generally along planes, said plane along which lies one said seal extending in one direction generally longitudinally along said tube and intersecting, at an angle, the plane along which lies each adjacent said seal.

2. The teether claimed in claim 1 in which said tube contains a nontoxic liquid or gel within the interior thereof.

3. The teether claimed in claim 1 in which said end seals lie along the same said plane, said teether is formed in a loop with said end seals joined together.

4. The teether claimed in claim 3 in which said tube contains a nontoxic liquid or gel within the interior thereof.

5. The teether claimed in claim 1 in which said planes of said adjacent seals are normal to each other.

6. The teether claimed in claim 1 in which said seals extend in straight lines in a direction across said tube at right angles relative to the tube axis.

7. The teether claimed in claim 6 in which said planes of said adjacent seals are normal to each other.

8. The teether claimed in claim 5 in which said seals are curvilinear in section along said planes.

9. The teether claimed in claim 7 in which said end seals lie along the same said plane, said teether is formed in a loop with said end seals meeting and overlying each other, and said end seals are sealed together.

10. The teether claimed in claim 9 in which said tube contains a nontoxic liquid or gel within the interior thereof.

* * * * *

Disclaimer 3,990,455.—*Richard L. Panicci*, Hanover, Mass. TEETHER. Patent dated Nov. 9, 1976. Disclaimer filed Jan. 21, 1977, by the assignee, *Kiddie Products, Inc.*

The term of this patent subsequent to Nov. 9, 1990, has been disclaimed.

[*Official Gazette March 29, 1977.*]